US007521866B2

(12) United States Patent
Jung et al.

(10) Patent No.: US 7,521,866 B2
(45) Date of Patent: Apr. 21, 2009

(54) PLASMA DISPLAY APPARATUS

(75) Inventors: Youn Jin Jung, Gumi-si (KR); Yun Gi Kim, Busan-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/723,342

(22) Filed: Mar. 19, 2007

(65) Prior Publication Data

US 2008/0018248 A1 Jan. 24, 2008

(30) Foreign Application Priority Data

May 22, 2006 (KR) ..... 10-2006-0045728
May 22, 2006 (KR) ..... 10-2006-0045729

(51) Int. Cl.
*H01J 17/49* (2006.01)

(52) U.S. Cl. ..... 313/582; 313/584; 313/587

(58) Field of Classification Search ..... 313/581–587
See application file for complete search history.

(56) References Cited

U.S. PATENT DOCUMENTS 6,097,149 A * 8/2000 Miyaji et al. ..... 313/582
6,838,828 B2 * 1/2005 Joo et al. ..... 313/584
7,323,819 B2 * 1/2008 Hong et al. ..... 313/584
2005/0242729 A1 * 11/2005 Kweon ..... 313/586

FOREIGN PATENT DOCUMENTS

JP 10-092325 4/1998
JP 2002-270101 9/2002
KR 10-2003-0071476 A 9/2003
KR 10-2003-0073173 A 9/2003

* cited by examiner

*Primary Examiner*—Ashok Patel
(74) *Attorney, Agent, or Firm*—KED & Associates, LLP

(57) ABSTRACT

A plasma display panel is provided that has an inter-electrode distance in a structure where a black layer and an electrode are separated from each other. The plasma display apparatus may have the effect that reactive current is reduced by lowering capacitance. Further, the plasma display panel may have the effect that emission of light by discharge is smoothly performed by controlling a width of an upper and lower portion of a second barrier rib and a width of the first barrier rib according to the width of the upper portion of the second barrier rib such that a luminance can be increased and interference of adjacent cells can be minimized. This may have an effect that a sustain period where an image is displayed can be secured relatively longer since an address time during which the scan pulse is applied is reduced.

19 Claims, 14 Drawing Sheets

PLASMA DISPLAY APPARATUS

This application claims the benefit of Korean Patent Application No. 10-2006-0045728 filed on May 22, 2006, and Korean Patent Application No. 10-2006-0045729 filed on May 22, 2006, which is hereby incorporated by reference for all purposes as if fully set forth herein.

BACKGROUND OF THE INVENTION

1. Field of the Invention

The present invention relates to a plasma display panel, more particularly, to an inter-electrode distance in the structure where a black layer and an electrode are separated from each other, and, to a width of a barrier rib in the structure where a black layer and an electrode are separated from each other.

2. Description of the Related Art

A plasma display panel hereinafter, PDP is an apparatus for displaying an image including a character and a graphic by performing a discharge through applying a predetermined voltage to electrodes arranged in a discharge space, and by exciting the phosphor with the plasma generated in the gaseous discharge time. The plasma display panel has an advantage in that a large size, a light weight and a plane thin shaping are facilitated, the wide viewing angle to the up down left right can be provided, and the full-color and the high luminance can be implemented.

The plasma display panel includes a front substrate and a rear substrate. On the front substrate, a transparent electrode and a plurality of sustain electrodes which are comprised of a bus electrode that is formed on the transparent electrode are disposed. On the rear substrate, a plurality of discharge spaces, that is, barrier ribs for forming a cell are disposed and a plurality third electrode intersecting with the sustain electrode are disposed.

The sustain electrode is classified into a bus electrode and a transparent electrode. As to the bus electrode, the inter-bus electrode distance in the cell is set to be a maximum. Thus, the bus electrode gets to be adjacent to the partition. At this time, the bus electrode and the barrier rib play a role of capacitor, while the panel capacitance increases due to the voltage accumulation. Moreover, there is a problem in that the consumption of the reactive current gets to increase due to the increment of the panel capacitance.

SUMMARY

Accordingly, an object of the present invention is to solve at least the problems and disadvantages of the background art.

The object of the present invention is to separate a bus electrode and a black layer from each other, to set up the ratio of the distance between the electrodes for reducing the panel capacitance between a front substrate and a rear substrate, to set up the optimal width and the ratio of a barrier rib and the black layer.

A plasma display apparatus according to an aspect of the present invention includes a front substrate where a first electrode is formed in parallel with a second electrode; a rear substrate where a third electrode is formed to intersect with the first electrode and the second electrode; and a first barrier rib and a second barrier rib that form a discharge cell by intersecting with each other between the front substrate and the rear substrate, wherein the second barrier rib is formed in parallel with the first electrode and the second electrode, wherein each of the first electrode and the second electrode is separately disposed into the direction of the center of the discharge cell from the edge of the upper portion of the second barrier rib, while the longest distance between the first electrode and the second electrode ranges from 0.5 times to 1 times of the distance between the edges of the upper portion of the second barrier rib.

A plasma display apparatus according to another aspect of the present invention includes a front substrate where a first electrode is formed in parallel with a second electrode; a rear substrate where a third electrode is formed to intersect with the first electrode and the second electrode; and a first barrier rib and a second barrier rib that form a discharge cell by intersecting with each other between the front substrate and the rear substrate, wherein the second barrier rib is formed in parallel with the first electrode and the second electrode, wherein each of the first electrode and the second electrode is separately disposed into the direction of the center of the discharge cell from the edge of the upper portion of the second barrier rib, while the width of the upper portion of the second barrier rib ranges from 40 μm to 100 μm.

A plasma display apparatus according to a further aspect of the present invention includes a front substrate where a first electrode is formed in parallel with a second electrode; a rear substrate where a third electrode is formed to intersect with the first electrode and the second electrode; and a first barrier rib and a second barrier rib that form a discharge cell by intersecting with each other between the front substrate and the rear substrate, wherein the second barrier rib is formed in parallel with the first electrode and the second electrode, wherein a black layer is formed on the second barrier rib, wherein each of the first electrode and the second electrode is separately disposed into the direction of the center of the discharge cell from the edge of the upper portion of the second barrier rib, while the width of the first black layer ranges from 0.8 times to 2.55 times of the width of the upper portion of the second barrier rib.

BRIEF DESCRIPTION OF THE DRAWINGS

The accompany drawings, which are included to provide a further understanding of the invention and are incorporated in and constitute a part of this specification, illustrate embodiments of the invention and together with the description serve to explain the principles of the invention. In the drawings.

DETAILED DESCRIPTION OF PREFERRED EMBODIMENTS

Reference will now be made in detail to embodiments of the present invention, examples of which are illustrated in the accompanying drawings.

Figure 1:
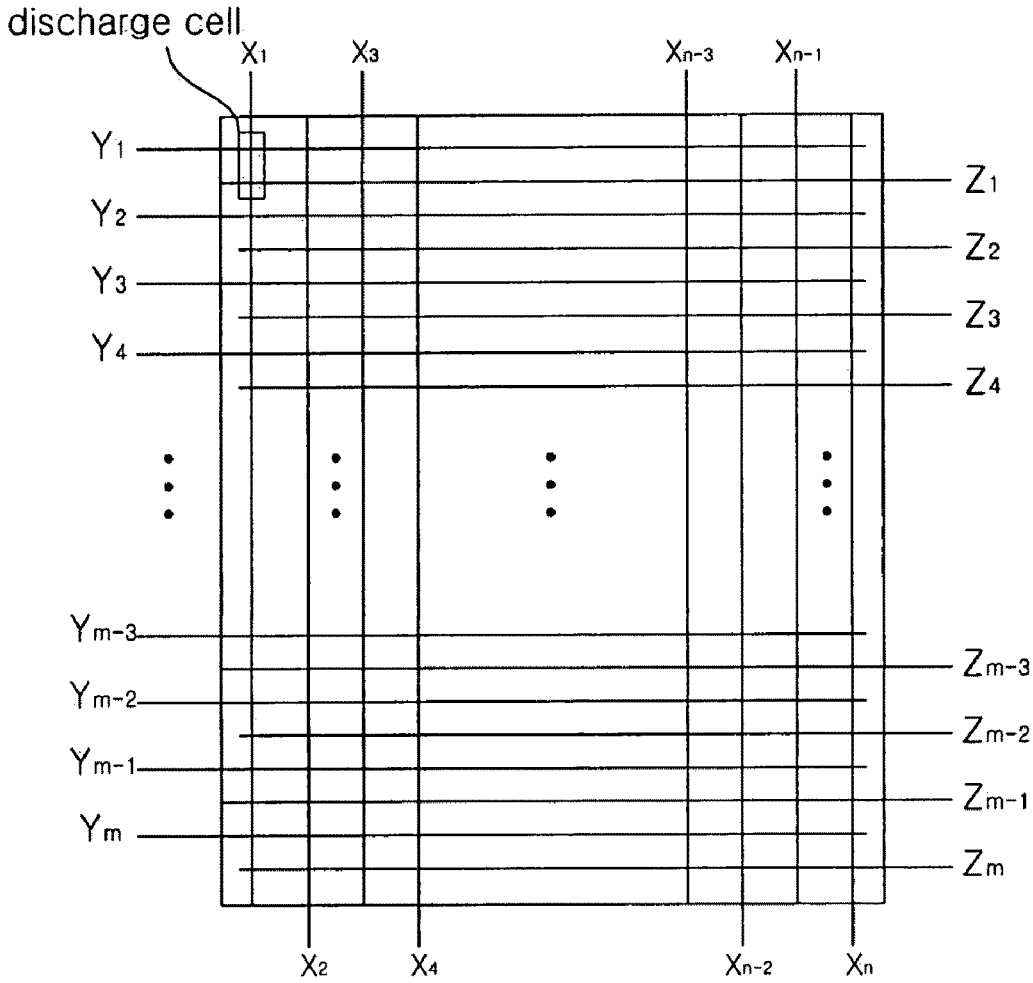
FIG. 1 is a drawing illustrating an embodiment of the electrode arrangement of a plasma display apparatus.

Hereinafter, the embodiment of the present invention will be described in detail with reference to FIG. 1 to FIG. 10*b*. FIG. 1 is a drawing illustrating an embodiment of the electrode arrangement of a plasma display apparatus. It is preferable that, as shown in FIG. 1, a plurality of discharge cells comprising the plasma display apparatus are arranged with a matrix type.

A plurality of discharge cells are prepared in the intersection of a first electrode line Y1 to Ym, a second electrode line Z1 to Zm and a third electrode line X1 to Xn. The first electrode line Y1 to Ym can be sequentially driven or can be simultaneously driven, while the second electrode line Z1 to Zm can be simultaneously driven. The third electrode line X1 to Xn can be divided into even number lines and odd number lines to be driven or can be simultaneously driven.

In the above, the first electrode can be named a scan electrode, while the second electrode can be named a sustain electrode. The third electrode can be named an address electrode.

The electrode arrangement shown in FIG. 1 is just an embodiment of the electrode arrangement of a plasma apparatus according to the present invention. Therefore, the invention is not restricted to the driving method and the electrode arrangement of the plasma display panel shown in FIG. 1. For example, a dual scan mode where two first electrode lines among the first electrode lines Y1 to Ym are simultaneously scanned can be available. Further, in the center area of the panel, the third electrode line X1 to Xn can be divided into an upper portion and a lower portion to be driven. At this time, it is preferable that the distance between the third electrodes which are divided into the upper portion and the lower portion is formed within the range of 70 to 200 μm so as to prevent the problem that a minute step height is generated in a screen due to the separation of the electrode line into the upper portion and the lower portion.

Figure 2:
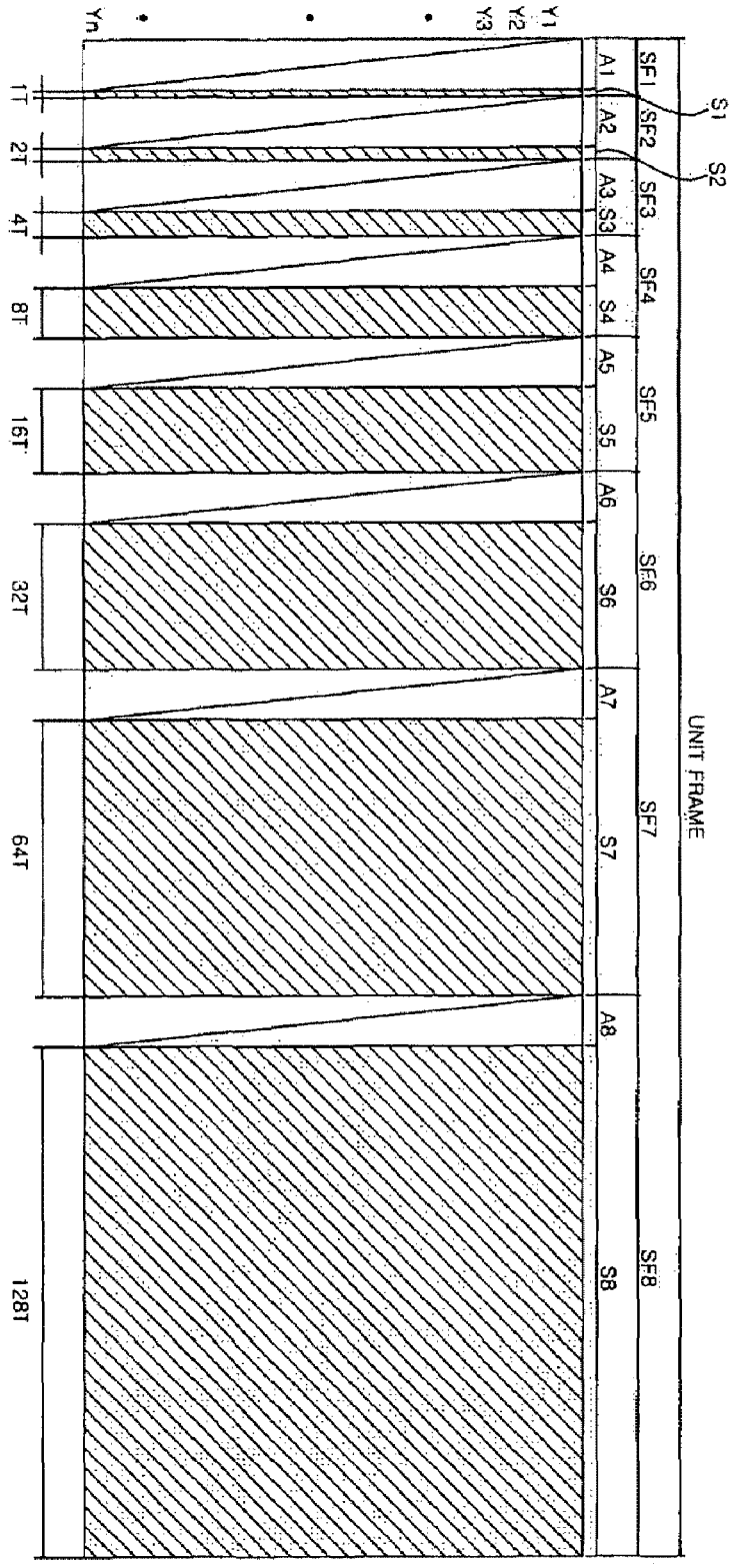
FIG. 2 is a timing diagram illustrating an embodiment of the method of time divided driving by dividing one frame into a plurality of subfields.

FIG. 2 is a timing diagram illustrating an embodiment of the method of time divided driving by dividing one frame into a plurality of subfields. Referring to FIG. 2, the unit frame can be divided into a predetermined number, for example, 8 subfields SF1, . . . , SF8 so as to implement a time divided grayscale. Further, each subfield SF1, . . . , SF8 is divided into a reset period not shown, an address period A1, . . . , A8, and a sustain period S1, . . . , S8.

Here, according to the embodiment of the present invention, the reset period can be omitted in at least one subfield among a plurality of subfields. For example, the reset period can exist only in the first subfield, or exist in the intermediate subfield between the first and the total subfield.

In each address period A1, . . . , A8, an address signal is applied to the third electrode X, while the scan signal corresponding to each first electrode Y is sequentially applied to one or two first electrode lines.

In each sustain period S1, . . . , S8, a sustain signal is alternately applied to the first electrode Y and the second electrode Z such that a sustain discharge is generated in discharge cells in which wall charges are formed in the address period A1, . . . , A8. Further, according to the embodiment of the present invention, at least one among a plurality of sustain periods can be omitted, and the sustain signal can be applied to only one of the first electrode Y and the second electrode Z. In this way, in case the sustain period is omitted or the sustain signal is applied to only one electrode, the grayscale can be increased. It is preferable that such implementation is applied to the first sustain address S1 to the third sustain address S3.

The luminance of the plasma display panel is in proportion to the number of the sustain discharge pulse in the sustain discharge period S1, . . . , S8 of an unit frame. In case one frame forming one image is expressed with 8 subfields and 256 gray scales, the sustain signal having different number can be allocated to each subfield in the rate of 1, 2, 4, 8, 16, 32, 64, 128. To obtain the luminance of 133 gray scale, cells are addressed during subfield 1 period, subfield 3 period and subfield 8 period to perform a sustain discharge.

According to the weighted value of the subfields depending on APC (Automatic Power Control) step, the sustain discharge number allocated to each subfield can be variably determined. That is, in FIG. 3, it is exemplified that one frame is divided into 8 subfields. However, the invention is not restricted to such case, but the number of the subfield forming one frame can be variously changed according to a design type. For example, a frame can be divided into 8 subfields or more such as 12 subfields, or 16 subfields to drive the plasma display panel.

Figure 3:
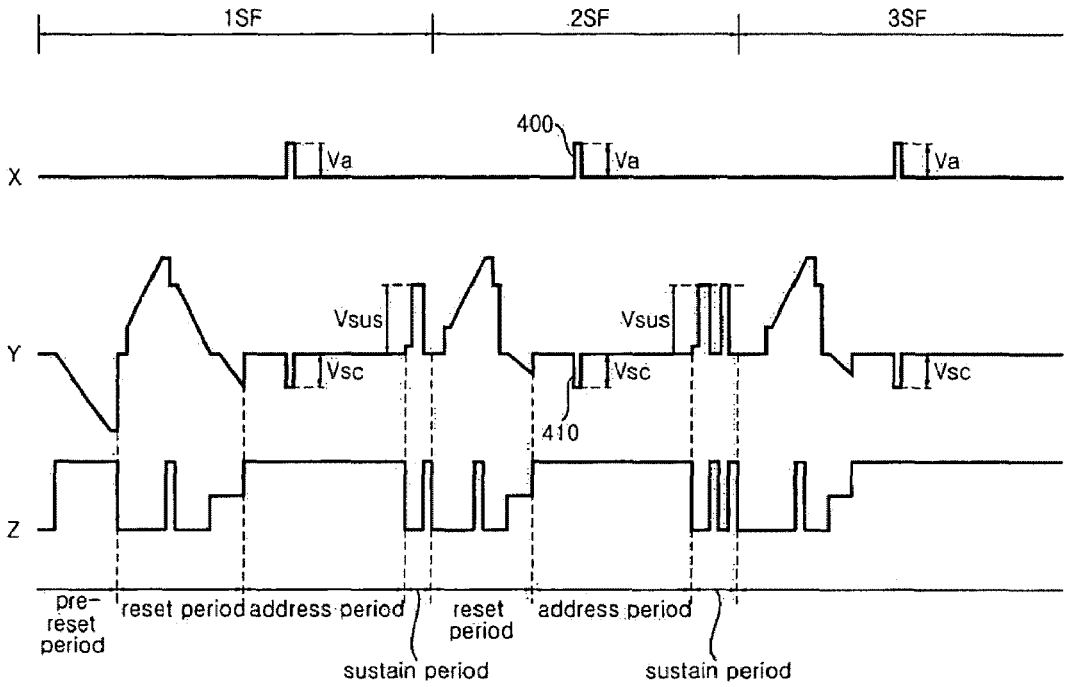
FIG. 3 is a timing diagram illustrating an embodiment of the driving signals for driving a plasma display apparatus in one divided subfield.

FIG. 3 is a timing diagram illustrating an embodiment of the driving signals for driving a plasma display apparatus in one divided subfield.

The subfield includes a pre reset period for forming positive wall charges on the first electrodes Y and negative wall charges on the second electrodes Z, a reset period for initializing the discharge cells of the full screen by using the wall charge distribution formed by the pre reset period, an address period for selecting the discharge cell and a sustain period for maintaining the discharge of the selected discharge cells.

The reset period is comprised of a setup period and a setdown period. In the setup period, a ramp-up waveform is simultaneously applied to all first electrodes to generate a microdischarge in all discharge cells. Accordingly, wall charges are generated. In the set down period, a ramp-down waveform falling from the positive polarity voltage lower than the peak voltage of the ramp-up waveform is applied to all first electrodes Y to generate an erase discharge in all discharge cells. Accordingly, the wall charges generated by the setup discharge and an unnecessary charge among space discharges are erased.

Further, according to the embodiment of the present invention, the set up period in which the ramp-up waveform is applied is omitted in at least one subfield among a plurality of subfields such that the set down period in which the ramp-down waveform is applied can only exist. In this way, although the set up period is omitted and the set down period only exists in at least one subfield, the initialization of the discharge cell is possible. In addition, the driving time margin increases such that it is advantageous for driving, especially, for single scan driving.

In the address period, the scan signal 410 that has scan voltage Vsc of negative polarity is sequentially applied to the first electrode, while the address signal 400 that has address voltage Va of positive polarity is applied to the third electrode X so as to be overlapped with the scan signal. The address discharge is generated due to the width of the voltage of the scan signal 410 and the address signal 400 and the wall voltage generated during the reset period, thereby, a cell is selected. In the meantime, during the set down period and the address period, a signal maintaining the sustain voltage is applied to the second electrode.

In the sustain period, the sustain signal is alternately applied to the first electrode and the second electrode and the sustain discharge is generated between the first electrode and the second electrode as a surface discharge.

The drive waveforms shown in FIG. 3 are a first embodiment of the signals for driving a plasma display apparatus according to the present invention. The invention is not restricted by waveforms shown in FIG. 3. For example, the pre reset period can be omitted and the polarity and the voltage level of the driving signals shown in FIG. 3 can be changed, if necessary. Further, the erase signal for erasing the wall charge can be applied to the second electrode after the sustain discharge is completed.

Moreover, the single sustain drive mode in which the sustain signal is applied to only one of the first electrode Y and the sustain electrode Z to generate the sustain discharge. The panel to which such drive waveform is supplied is formed as shown in FIG. 4.

Figure 4:
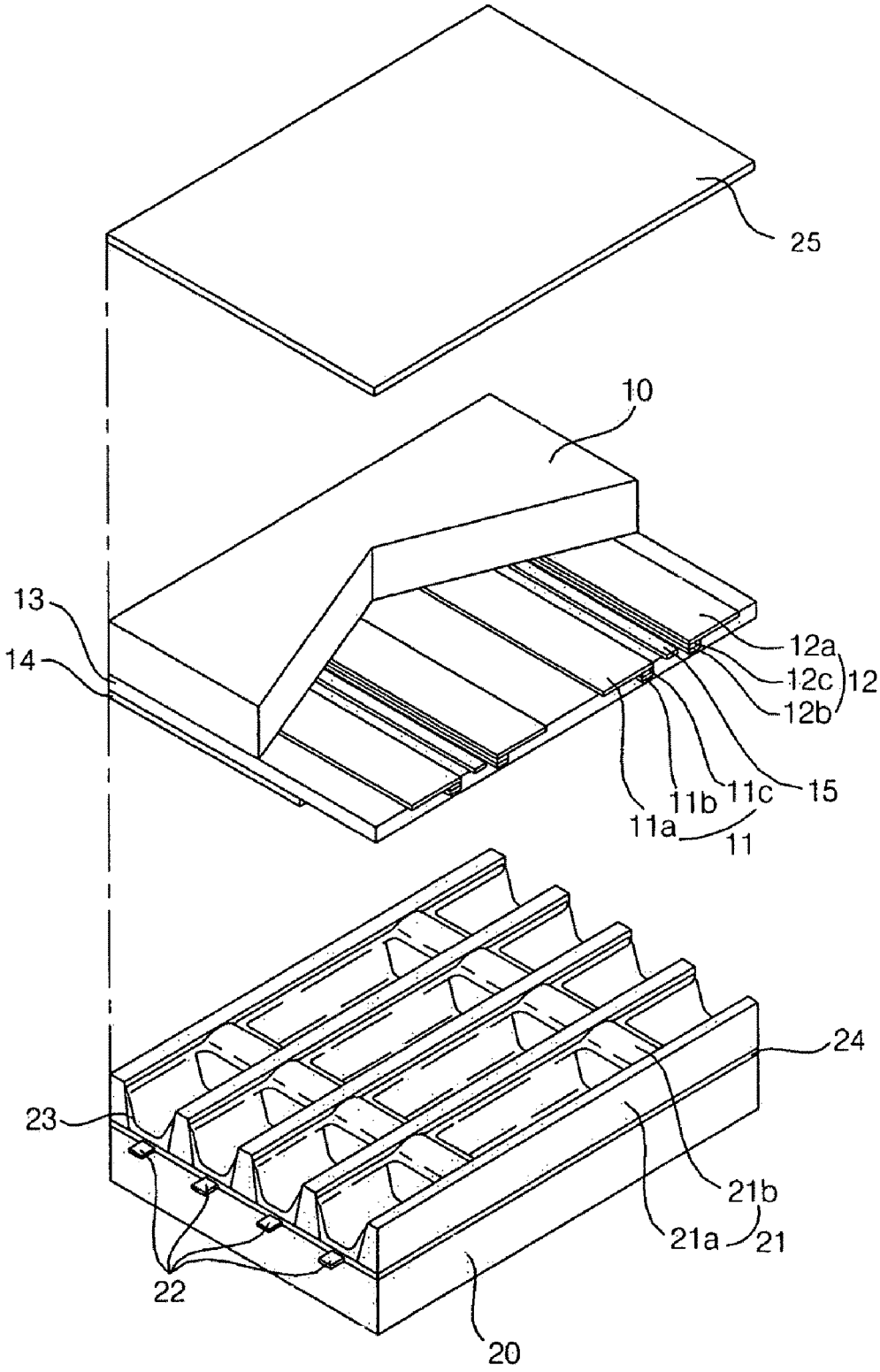
FIG. 4 is a perspective view illustrating an embodiment of the structure of a plasma display apparatus according to the present invention.

FIG. 4 is a perspective view illustrating an embodiment of the structure of a plasma display apparatus according to the present invention.

As shown in FIG. 4, the plasma display apparatus includes a first electrode 11 and a second electrode 12 which are a sustain electrode pair formed in the front substrate 10 and a third electrode 22 formed in the rear substrate 20.

Generally, the sustain electrode pair 11, 12 includes a transparent electrode 11*a*, 12*a* formed of Indium-Tin-Oxide ITO and a bus electrode 11*b*, 12*b*. The bus electrode 11*b*, 12*b* can be formed of the stack of metal such as silver Ag, chrome Cr or chrome/copper/chrome Cr/Cu/Cr or the stack of chrome/aluminium/chrome Cr/Al/Cr. Bus electrode 11*b*, 12*b* is formed on the transparent electrode 11*a*, 12*a* and plays a role of reducing the voltage drop by the transparent electrode 11*a*, 12*a* having a high resistance. At this time, during the first electrode discharge and the second electrode discharge, it is preferable that the distance between the transparent electrodes 11*a*, 12*a* for maximizing the discharge efficiency ranges from 90 μm to 150 μm.

In the meantime, according to the embodiment of the present invention, the sustain electrode pair 11, 12 can be comprised of only the bus electrode 11*b*, 12*b* without the transparent electrode 11*a*, 12*a* as well as the structure in which the transparent electrode 11*a*, 12*a* and the bus electrode 11*b*, 12*b* are laminated. Such structure has an advantage in that the cost of the panel manufacture can be reduced since the transparent electrode 11*a*, 12*a* is not used. Various materials including a photoresist material are available for the bus electrode 11*b*, 12*b* used for such structure except the materials mentioned above.

According to the embodiment of the present invention, the black layer which absorbs the external light to reduce a reflection and improves a contrast is formed on the front substrate 10. It can be comprised of a first black layer 15 which is formed in the position overlapped with the barrier rib 21, and a second black layers 11*c*, 12*c* formed between the transparent electrode 11*a*, 12*a* and the bus electrode 11*b*, 12*b*. Here, the first black layer 15 and the second black layers 11*c*, 12*c* are separated so as not to be physically connected. In this case, the first black layer 15 and the second black layers 11*c*, 12*c* can be formed with a different material. On the front substrate 10 in which the first electrode 11 and the second electrode 12 are formed side by side, a front dielectric layer 13 and a protective layer 14 are laminated. On the front dielectric layer 13, charged particles generated by a discharge are accumulated. The front dielectric layer 13 can play a role of protecting a sustain electrode pair 11, 12. The protective layer 14 protects the front dielectric layer 13 from the sputtering of the charged particles generated during the gaseous discharge, emitting the secondary electron to enhance the discharge efficiency.

Further, the third electrode 22 is formed in the direction intersecting with the first electrode 11 and the second electrode 12. On the rear substrate 20 in which the third electrode 22 is formed, a rear dielectric layer 24 and a barrier rib 21 are formed. A phosphor layer 23 is formed on the surface of the barrier rib 21 and the rear dielectric layer 24.

The barrier rib 21 including a first barrier rib 21*a* and a second barrier rib 21*b* physically partitions the discharge cell. The second barrier rib 21*b* is formed in the direction where the sustain electrode 11, 12 of the front substrate 10 extends, while the first barrier rib 21*a* is formed into the direction different from the direction of the second barrier rib 21*b* to intersect with the second barrier rib 21*b*.

Referring to FIG. 4, it is preferable that a filter 25 is formed on the front of the plasma display panel according to the embodiment of the present invention, while an external light blocking layer, an Anti-Reflection AR layer, an Near Infrared NIR shielding layer or an ElectroMagnetic Interference EMI shielding layer can be included in the filter 25.

In the embodiment of the present invention, the structure of the barrier rib 21 having various shapes as well as the structure of the barrier rib 21 shown in FIG. 4 can be available. For example, a differential type barrier rib structure where the height of the first barrier rib 21*a* is different from the second barrier rib 21*b*, a channel type barrier rib structure where a channel which can be used as a ventilating passage is formed in at least one of the first barrier rib 21*a* and the second barrier rib 21*b*, and a groove type barrier rib structure where hollows are built up in at least one of the first barrier rib 21*a* and the second barrier rib 21*b* can be used.

Here, in case of the differential type barrier rib structure, it is preferable that the height of the first barrier rib 21*a* is higher than the second barrier rib 21*b*, while, in case of the channel type barrier rib structure or the groove type barrier rib structure, it is preferable that a channel or a hollow is formed in the second barrier rib 21*b*.

In the meantime, in the embodiment of the present invention, it is illustrated that R, G and B discharge cells are arranged in the identical line. However, other arrangements can be used. For example, the arrangement of a delta type where R, G, and B discharge cells are arranged in a triangle form can be used. Further, as to the shape of the discharge cell, various polygonal shapes including the pentagon, the hexagon as well as the square shape can be used.

The phosphor layer 23 is light-emitted by the ultraviolet ray generated during the gaseous discharge to generate a visible light which is one of Red R, Green G, and Blue B. Here, an inert mixing gas for a discharge including He+Xe, Ne+Xe and He+Ne+Xe is injected into the discharge space prepared in the front/rear substrate 10, 20 and the barrier rib 21.

As to the plasma display apparatus having such structure, the black layer illustrated in FIG. 4 will be described in detail with reference to FIG. 5A and FIG. 5B.

Figure 5A:
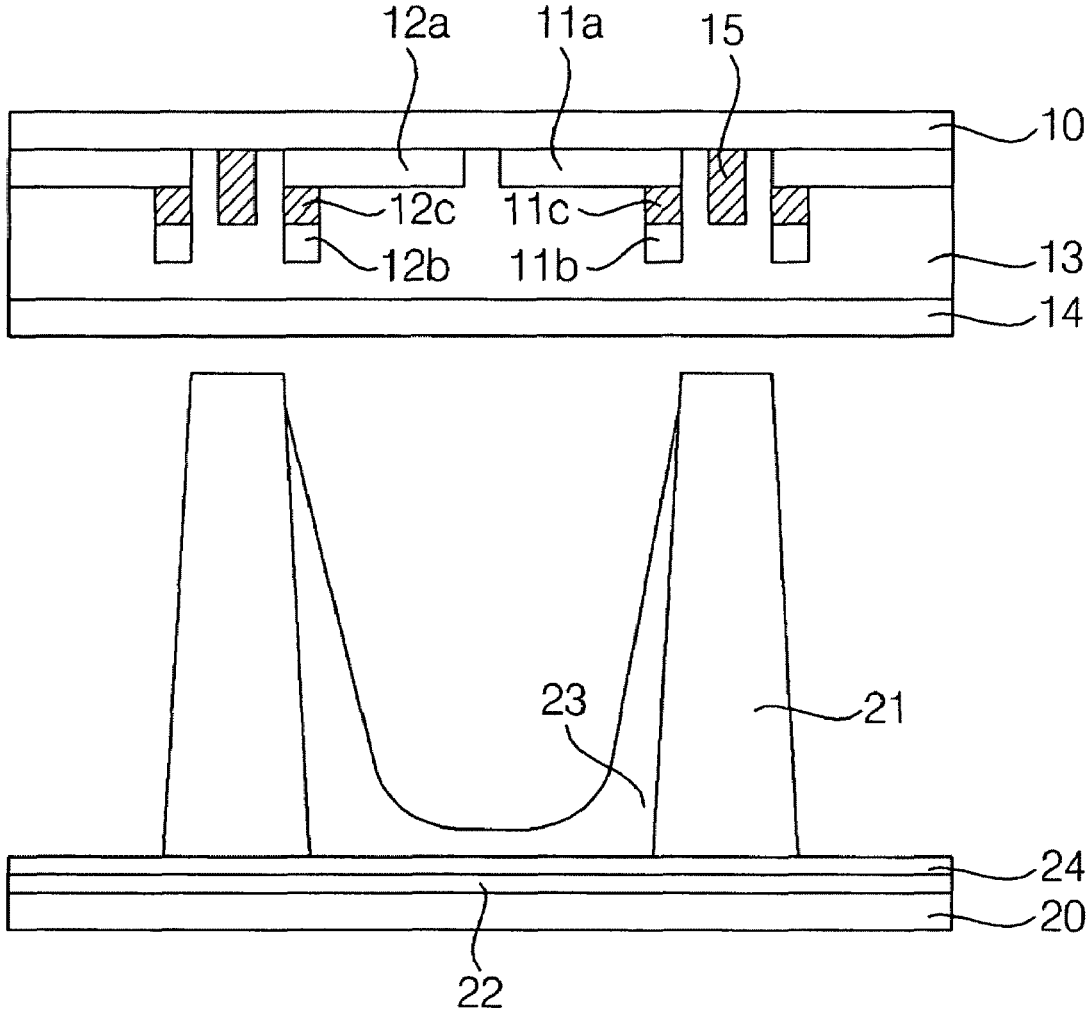
FIG. 5*a* to FIG. 5*b* are a cross section view illustrating an embodiment of the structure of a panel including a separate type BM according to the present invention.
Figure 5B:
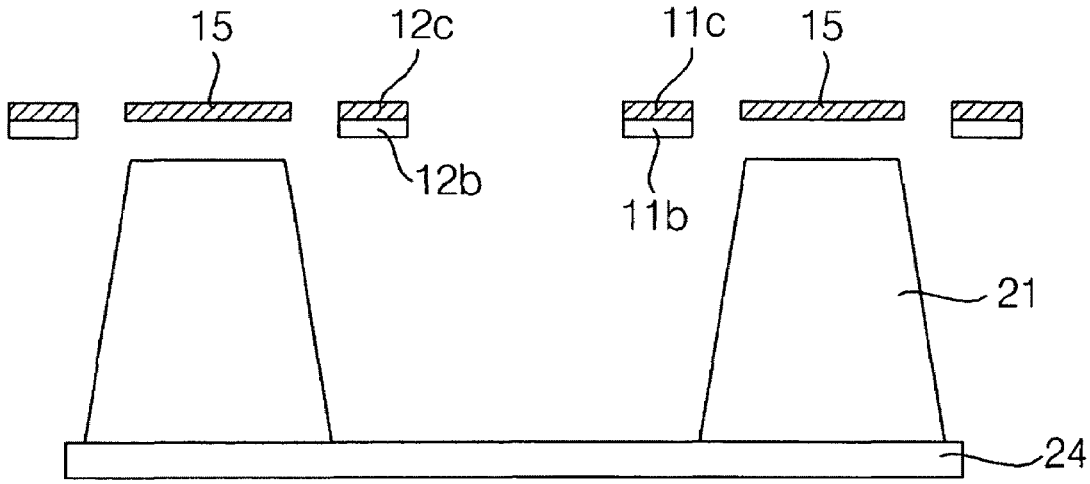

FIG. 5*a* to FIG. 5*b* are a cross section view illustrating an embodiment of the structure of a panel including a separate type BM according to the present invention.

As to the separate type BM, the light generated by the discharge can be radiated between the first, the second black layer 15, 11*c*, 12*c* to the outside of the panel to increase a luminance. At this time, the luminance of the panel is increased as the light generated in the discharge cell is more emitted to the outside, while the distance between electrodes in the discharge cell is in proportion to the quantity of the light emission. In this way, the luminance of the panel is increased as the distance between the electrodes is increased.

Here, the width of the first black layer 15 can be formed broader than the width of the second black layer 11*c*, 12*c*.

In the embodiment of the present invention, since the bus electrode 11*b*, 12*b* is positioned in the discharge space, the panel capacitance between the bus electrode 11*b*, 12*b* and the barrier rib 21 is reduced. That is, the barrier rib 21 and the bus electrodes 11*b*, 12*b* play a role of a capacitor to generate a panel capacitance. In case the bus electrode 11*b*, 12*b* is positioned in the region overlapped with the barrier rib 21, the panel capacitance is increased. That is, as the region where the bus electrode 11*b*, 12*b* is overlapped with the second barrier rib 21*b* is increased, the panel capacitance tends to increase. As the panel capacitance is increased, the consumption of the reactive power in the panel is increased such that the efficiency of the panel is decreased. Therefore, in the embodiment of the present invention, the relation between the second barrier rib 21*b* and the bus electrode 11*b*, 12*b* will be described with reference to FIG. 6, FIG. 7*a* and FIG. 7*b* to reduce the consumption of the reactive power and to improve the efficiency of the panel.

Figure 6:
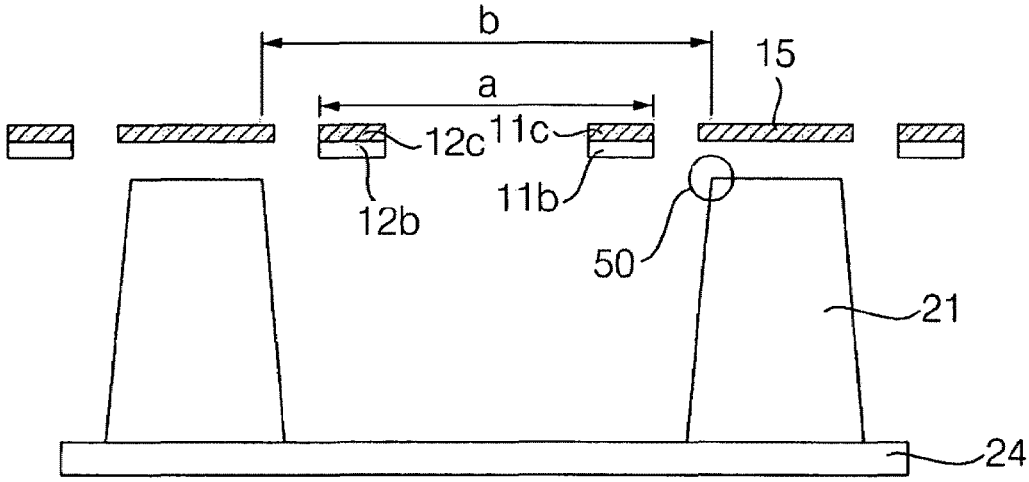
FIG. 6 is a cross section view of a panel according to the present invention.

FIG. 6 is a cross section view of a panel according to the present invention.

In FIG. 6, the reference sign 'a' denotes the longest distance between the bus electrodes 11*b*, 12*b* which are adjacent in the discharge cell, while the reference sign 'b' denotes the distance between the upper corners 50 of the inner side of two second barrier ribs 21*b*.

At this time, the upper corner 50 of the inner side of the second barrier rib 21*b* is determined as the most close area to outer side of the bus electrode 11*b*, 12*b* in the most upper portion of the inner side of the second barrier rib 21*b*. That is, according to the embodiment of the present invention, the bus electrode 11*b*, 12*b* is positioned in the inside of the discharge space between the second barrier ribs 21*b*, while it is not overlapped with the upper corner 50 of the inner side of the second barrier rib 21*b*. Therefore, according to the embodiment of the present invention, the bus electrode 11*b*, 12*b* can be overlapped with the other region except the upper corner 50 of the inner side of the second barrier rib 21*b*, for example, the bottom portion or the middle portion of the second barrier rib 21*b*.

At this time, as described above, the upper corner 50 of the inner side of the second barrier rib 21*b* was determined as the most close area to the outer side of the bus electrode 11*b*, 12*b*, since the present invention controls the gap between the bus electrode 11*b*, 12*b* and the second barrier rib 21*b* to reduce the panel capacitance.

In the meantime, not shown in FIG. 6, at least a part of or the whole of the transparent electrode 11*a*, 12*a* is positioned in the inside of the discharge cell and can be overlapped with the first black layer 11*c*, 12*c*.

Figure 7A:
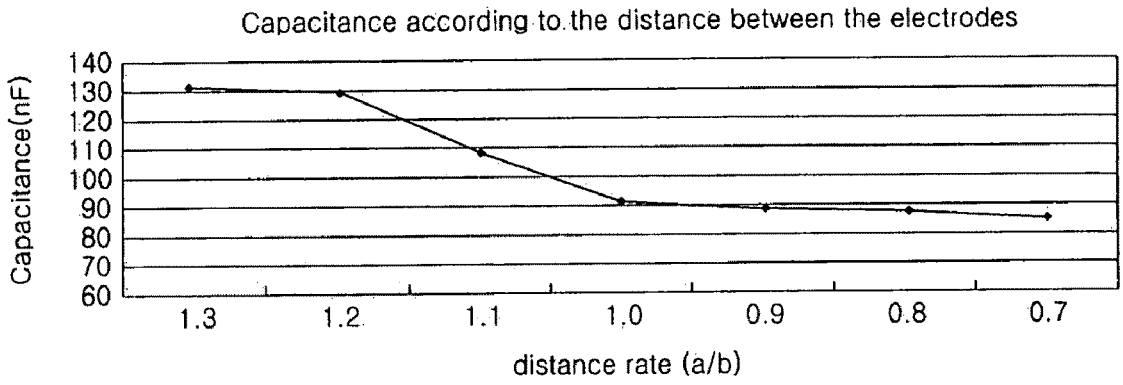
FIG. 7*a* is a graph illustrating the change of the panel capacitance according to the rate of the distance between barrier ribs and the distance between electrodes.
Figure 7B:
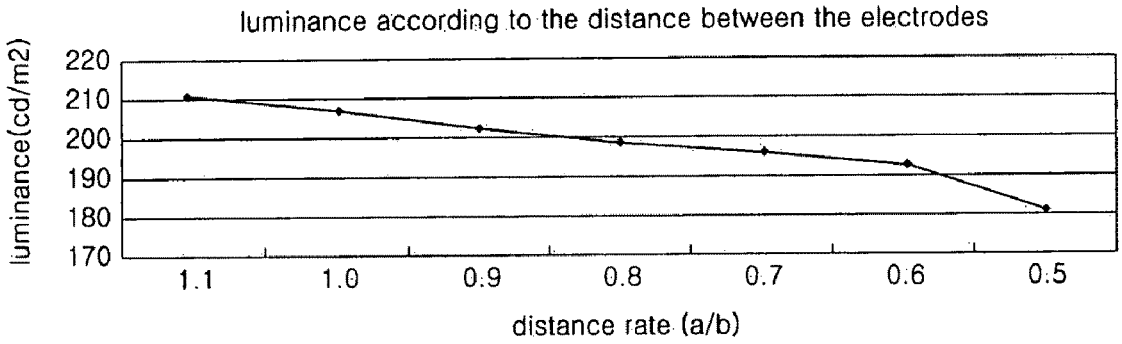
FIG. 7*b* is a graph illustrating the change of the luminance according to the rate of the distance between barrier ribs and the distance between electrodes.

FIG. 7*a* is a graph illustrating the change of the panel capacitance according to the rate of the distance between barrier ribs and the distance between electrodes, and FIG. 7*b* is a graph illustrating the change of the luminance according to the rate of the distance between barrier ribs and the distance between electrodes.

As shown in FIG. 7*a*, as to the panel capacitance, the rate a/b which is the distance of the bus electrodes 11*b*, 12*b* for the distance of the second barrier rib 21*b* abruptly decreases between 1.0 and 0.8. Further, as shown in FIG. 7*b*, the luminance is increased as the rate of the distance of the bus electrodes 11*b*, 12*b* for the distance of the second barrier rib 21*b* increases, while it rapidly increases when the rate a/b is 0.5 or more.

In this way, through the graph for the panel capacitance and luminance, if the rate of the distance of the bus electrodes 11*b*, 12*b* for the distance of the second barrier rib 21*b* is $0.5<a/b<1$, the luminance is not so much reduced, while the panel capacitance so much reduced, thereby, the efficiency of the panel is improved. According to the embodiment of the present invention, preferably, it is illustrated that the efficiency of the panel is more improved in case the value a/b ranges from 0.6 to 0.8 with reference to FIG. 7*a*, FIG. 7*b*.

Figure 8:
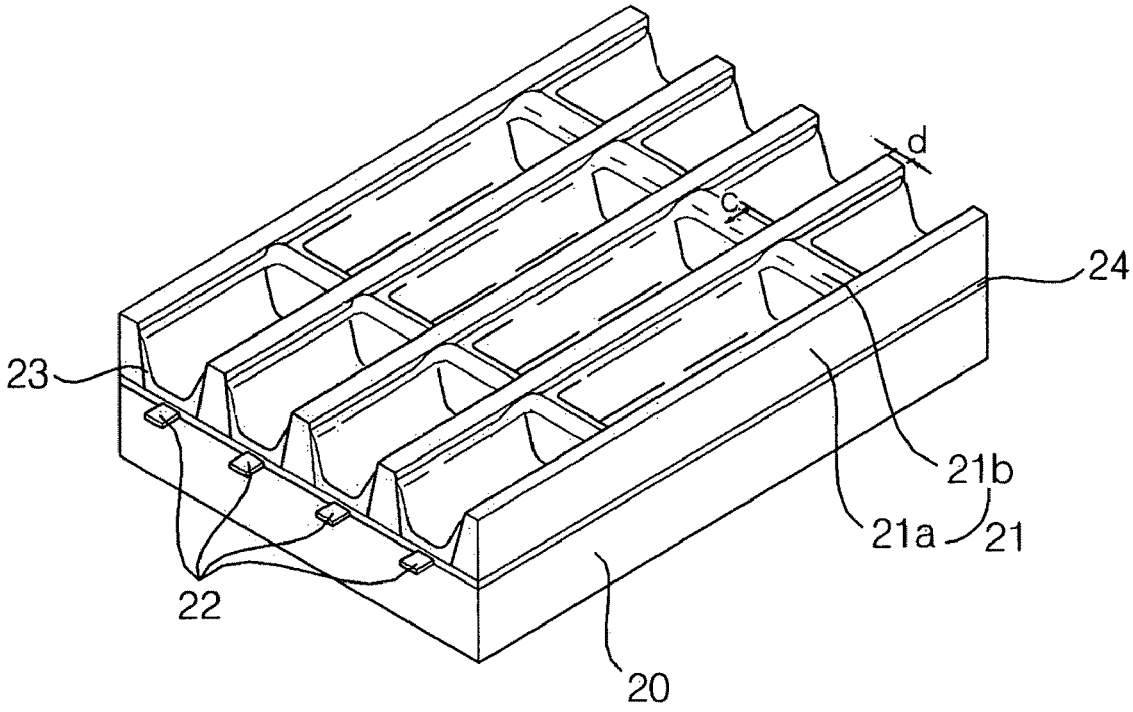
FIG. 8 is a drawing illustrating an embodiment of a panel in which a first barrier rib and a second barrier rib of a plasma display apparatus according to the present invention are formed.

FIG. 8 is a drawing illustrating an embodiment of a panel in which a first barrier rib and a second barrier rib of a plasma display apparatus according to the present invention are formed.

As shown in FIG. 8, the discharge cell is surrounded with the second barrier rib 21*b* and the first barrier rib 21*a*. The width of the upper portion of the barrier rib 21 means the width c of the upper portion of the second barrier rib 21*b* and the width d of the upper portion of the first barrier 21*a*.

At this time, a proper value of the width c of the upper portion of the second barrier rib 21*b* for improving the efficiency of the discharge of the adjacent cells and reducing the interference is suggested.

Figure 9A:
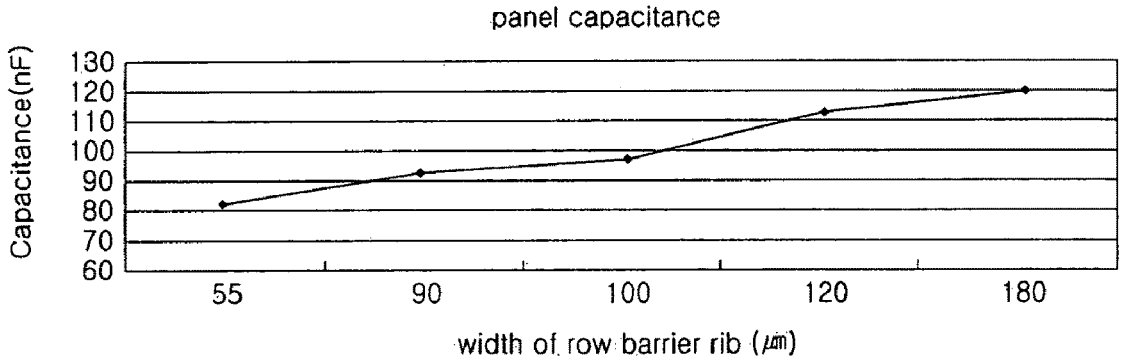
FIG. 9*a* is a graph illustrating the change of the panel capacitance according to the width of the upper portion of the second barrier rib.
Figure 9B:
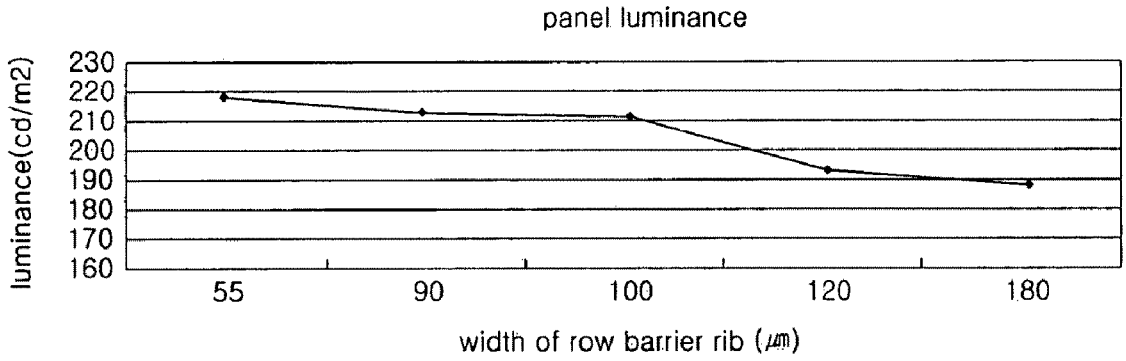
FIG. 9*b* is a graph illustrating the change of the luminance according to the width of the upper portion of the second barrier rib.

FIG. 9*a* is a graph illustrating the change of the panel capacitance according to the width of the upper portion of the second barrier rib, and FIG. 9*b* is a graph illustrating the change of the luminance according to the width of the upper portion of the second barrier rib.

As shown in FIG. 9*a*, as to the panel capacitance, it rapidly increases when the width c of the upper portion of the second barrier rib 21*b* is 100 μm or more, while it decreases when the width c of the upper portion of the second barrier rib 21*b* is 100 μm or less. Further, as shown in FIG. 9*b*, as to the luminance, it rapidly increases when the width c of the upper portion of the second barrier rib 21*b* is 120 μm or less while it is stable below 100 μm.

At this time, it can be known that the panel capacitance reduces as the width c of the upper portion of the second barrier rib 21*b* becomes narrower. However, there is a problem in that in case the width c of the upper portion of the second barrier rib 21*b* is smaller than 40 μm, the manufacture of the second barrier rib 21*b* becomes very difficult in the process, and the alignment of the sustain electrode pair also becomes difficult.

That is, in the embodiment of the present invention, the optimal range of the width c of the upper portion of the second barrier rib 21*b* where the panel capacitance reduces and the luminance is increased is limited to $40\ \mu m \leqq c \leqq 100\ \mu m$, however, afterwards, the width c of the upper portion of the second barrier rib 21*b* can be smaller than 40 μm or less according to the manufacturing technology of the barrier rib. That is, in the embodiment of the present invention, considering the tolerance or the yield of the panel manufacturing, the width c of the upper portion of the second barrier rib 21*b* was set to be 40 μm or more. However, in case the process improvement in the future is considered, the width c can not be limited to 40 μm, but can be 40 μm or less. In the meantime, considering the yield of the panel manufacturing or the reliability of the tolerance, it is more preferable that the width c of the upper portion of the second barrier rib 21*b* according to the embodiment of the present invention ranges from 55 μm to 100 μm.

Furthermore, preferably, the width d of the upper portion of the first barrier rib 21*a* is formed to be broader than the width c of the upper portion of the second barrier rib 21*b*, while the rate of the width d of the upper portion of the first barrier rib 21*a* and the width c of the upper portion of the second barrier rib 21*b* is 1:1 or 1:1.9. At this time, approximately, the optimal rate of the width d of the upper portion of the first barrier rib 21*a* and the width c of the upper portion of the second barrier rib 21*b* is 1:1. That is, also, as the width of the upper portion of the first barrier rib 21*a* decreases, the panel capacitance decrease, thereby, the panel efficiency is increased. As mentioned above, considering the manufacturing yield of the panel or the reliability of the tolerance, the minimum value of the width of the upper portion of the first barrier rib 21*a* can be reduced to the minimum value of the width c of the upper portion of the second barrier rib 21*b*. Furthermore, since the sustain electrode pair and the first black layer are formed on the front substrate overlapped with the upper portion of the second barrier rib 21*b*, it is preferable that the width c of the upper portion of the second barrier rib 21*b* is larger than the width d of the upper portion of the first barrier rib 21*a*, while it is 1.9 times or less than the width d of the upper portion of the first barrier rib 21*a* for the implementation of the super fine screen including Full HD.

The panel capacitance is generated between the barrier rib 21 and the bus electrode 11*b*, 12*b*. At this time, the value of the generated panel capacitance is changed depending on the distance between the second barrier rib 21*b* formed into the direction identical with the first direction in which bus electrode 11*b*, 12*b* is formed and the bus electrode 11*b*, 12*b*.

Figure 10A:
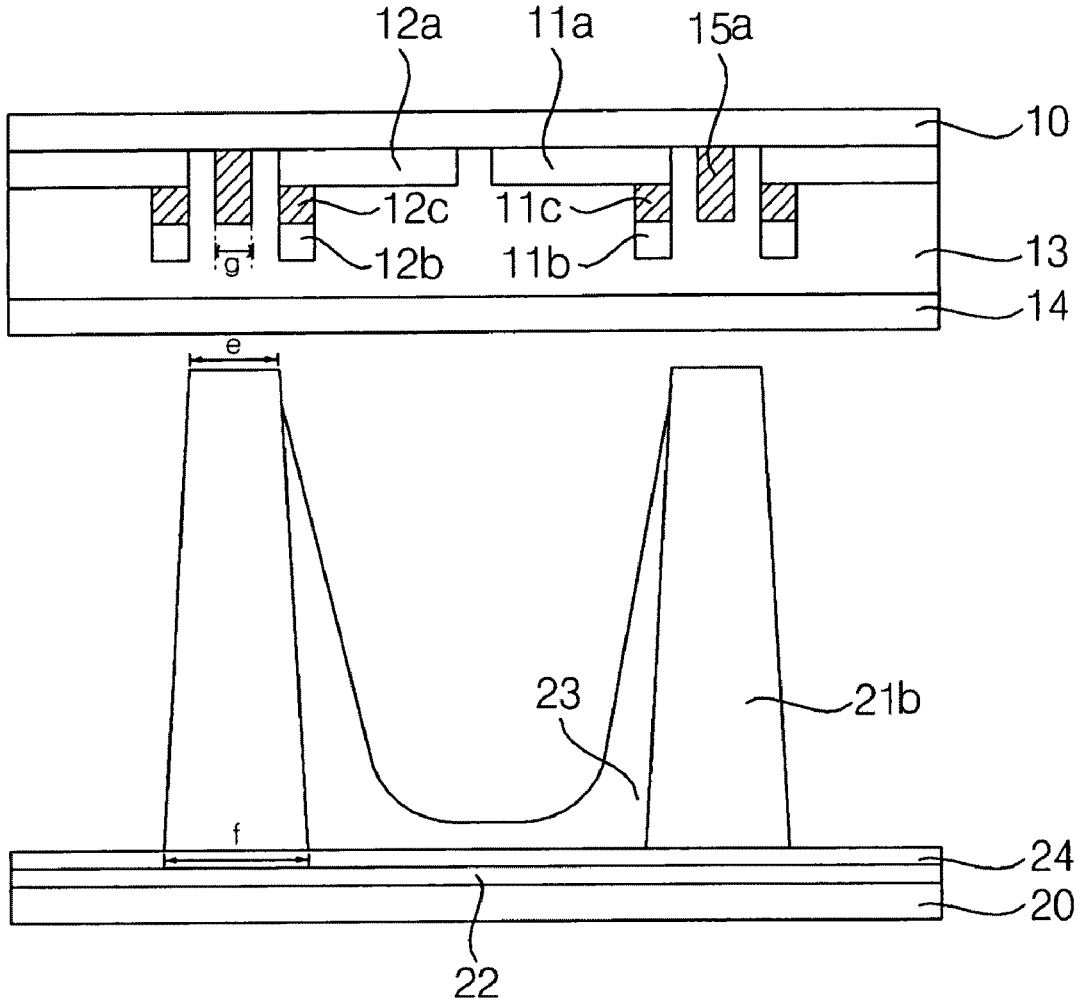
FIG. 10*a*, FIG. 10*b* are a drawing illustrating the cross section of a panel cut down in the direction intersecting with the sustain electrode according to an embodiment of the present invention.
Figure 10B:
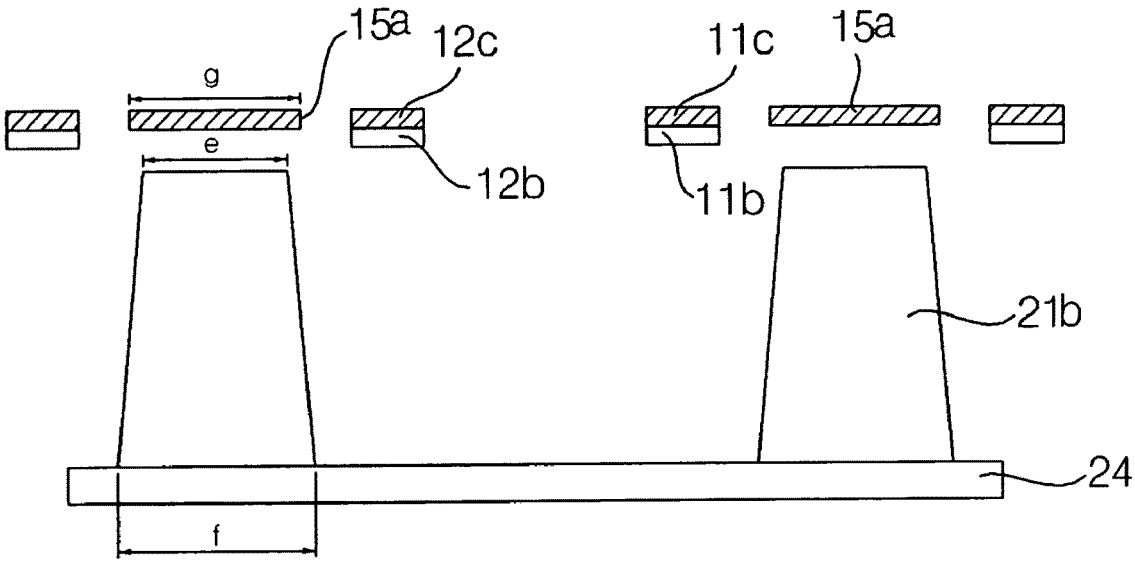

FIG. 10*a*, FIG. 10*b* are a drawing illustrating the cross section of a panel cut down in the direction intersecting with the sustain electrode according to an embodiment of the present invention.

As shown in FIG. 10*a*, FIG. 10*b*, it is preferable that, as to the second barrier rib 21*b*, the rate of the width e of the upper portion of the second barrier rib and the width f of the lower portion of the second barrier rib is 1:1 to 1:3 for increasing the discharge efficiency during the discharge within the cell. At this time, the width of the lower portion refers to the width of the part contacting with the rear dielectric layer 24.

The second barrier rib 21*b* and the first barrier 21*a* are formed with an optimal ratio such that the panel capacitance due to the area of the second barrier rib 21*b* can be reduced.

In the meantime, according to the embodiment of the present invention, the width g of the first black layer 15*a* illustrated in FIG. 4 to FIG. 5 ranges from 80 μm to 140 μm. It is seen that, in case the width g is compared with the width e of the upper portion of the second barrier rib 21*b*, the rate of the width e of the upper portion of the second barrier rib 21*b* and the width of the first black layer 15*a* is 1:1.08 to 1:2.5. That is, the first black layer 15*a* is formed on the upper substrate of the region overlapped with the second barrier rib 21*b* to prevent the light generated in the discharge cell from being emitted to the front substrate of the region overlapped with the second barrier rib 21*b*, thereby, it contributes to implement the clear picture quality. Therefore, in general, the first black layer 15*a* is not formed inside of the discharge cell so as not to affect the light emitted from the inside of the discharge cell. However, the quantity of the light emitted from the edge area, not from the central area, is very small in comparison with the quantity of the light emitted from the central area of the discharge cell. Thus, according to the embodiment of the present invention, the first black layer 15*a* is formed on the upper substrate of the position overlapped with the edge area of the discharge cell such that the reduction of the luminance can be decreased and the bright room contrast can be improved.

Figure 11A:
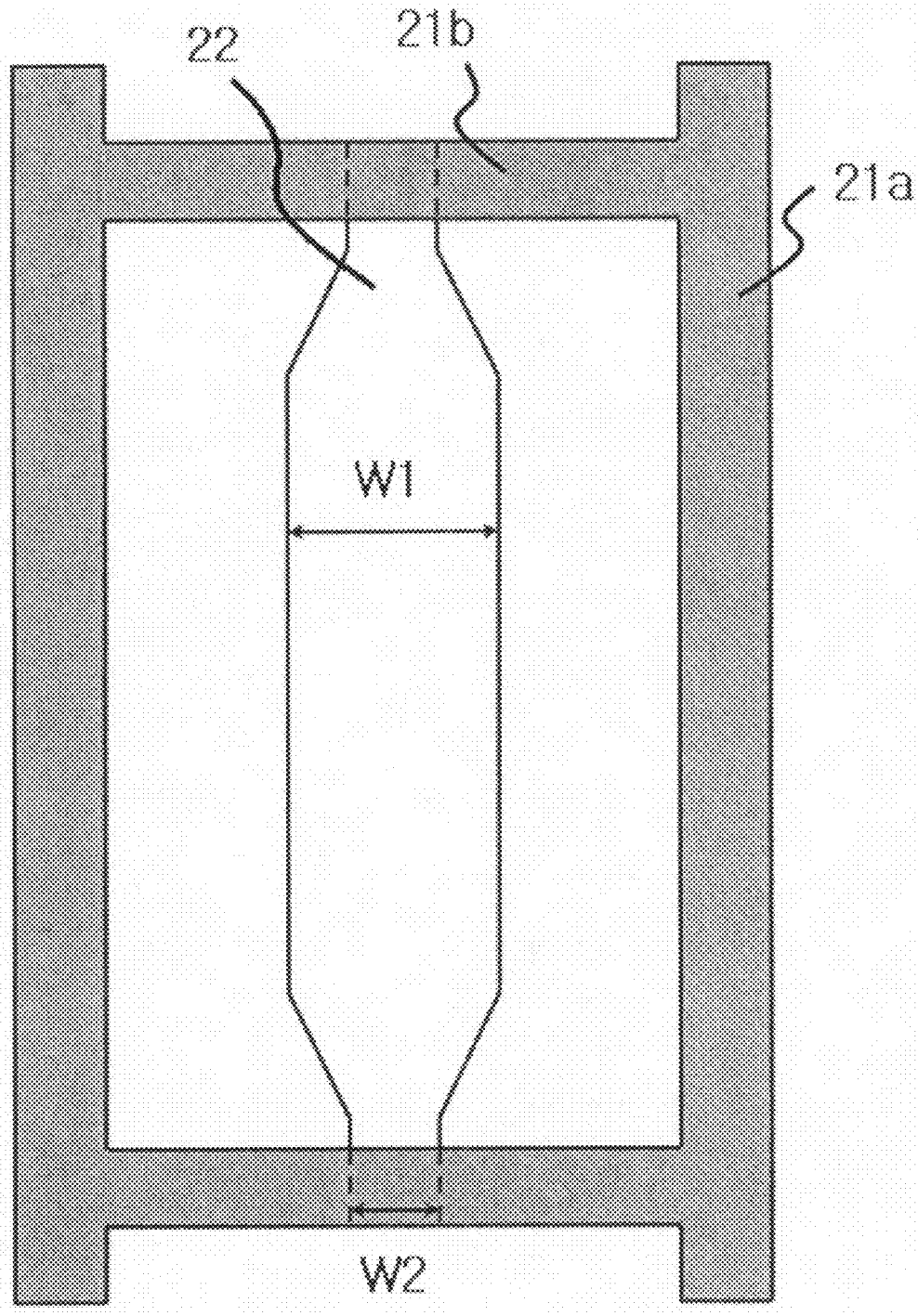
FIG. 11*a* to FIG. 11*c* are a drawing illustrating the structure of a third electrode of a plasma display apparatus according to an embodiment of the present invention.
Figure 11B:
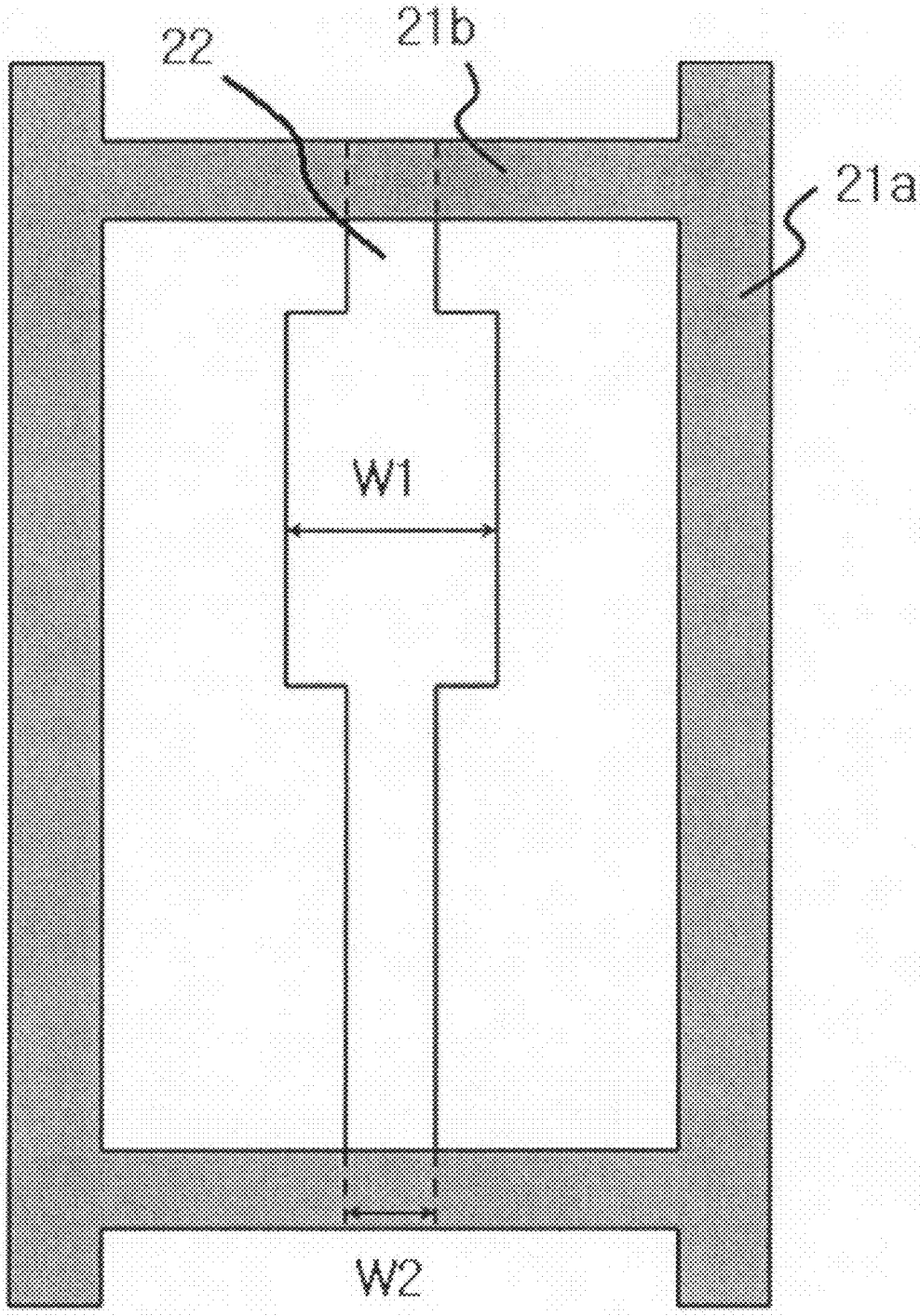
Figure 11C:
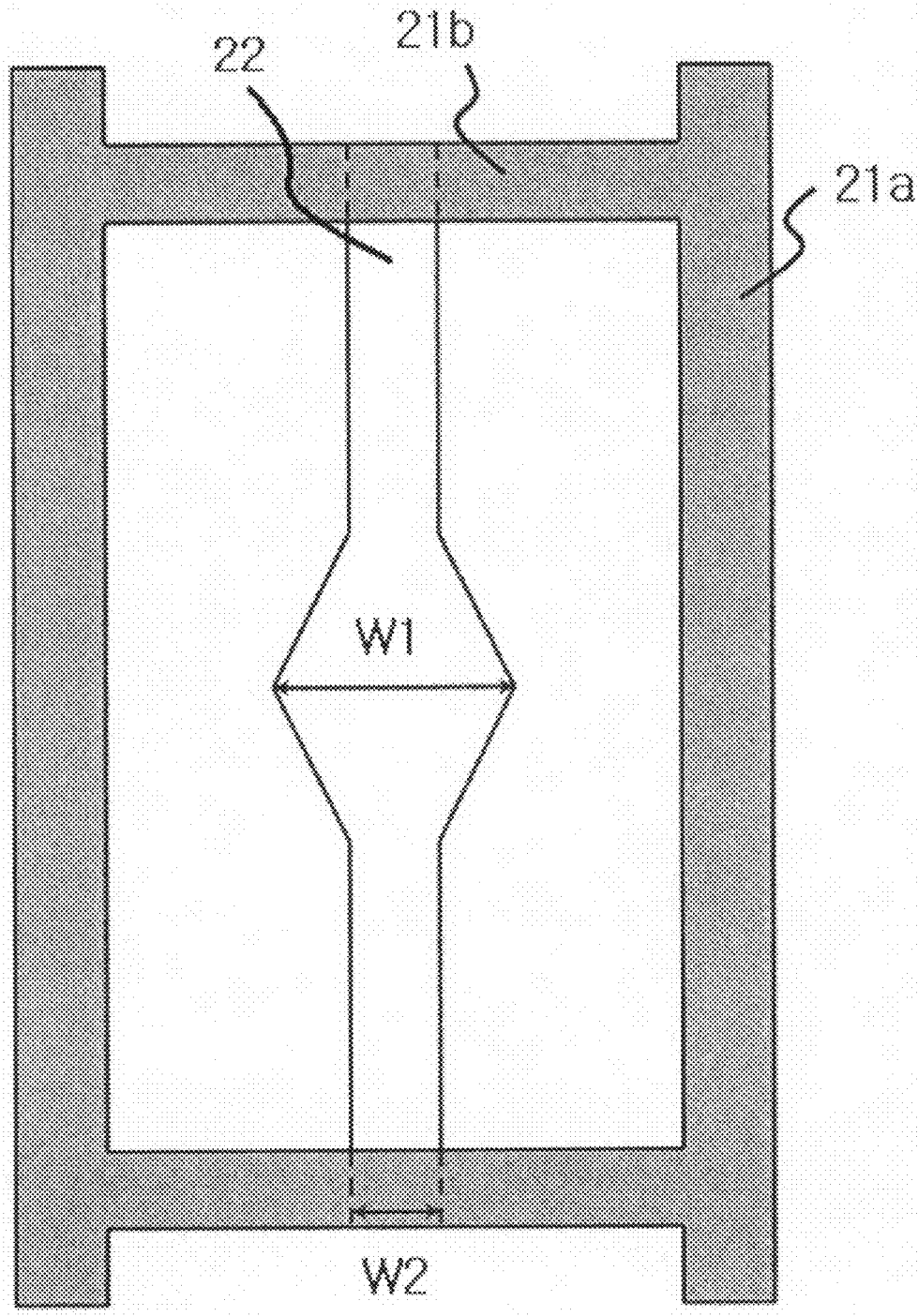

FIG. 11*a* to FIG. 11*c* are a drawing illustrating the structure of a third electrode of a plasma display apparatus according to an embodiment of the present invention.

Referring to FIG. 11*a*, the discharge cell is partitioned by the first barrier rib 21*a* and the second barrier rib 21*b*.

Here, the width of the third electrode 22 can be varied according to the position. For example, the width W1 of the third electrode 22 in the first position corresponding to the inside of the discharge cell can be different from a barrier rib, that is, the width W2 of the third electrode 22 in the second position corresponding to the second barrier rib 21*b*. For example, the width W1 of the third electrode 22 in the first position can be formed to be broader than the width W2 of the third electrode 22 on the second position such that the discharge characteristic can be improved.

That is, the region where the first electrode or the second electrode is overlapped with the third electrode 22 can be broadened such that the opposing discharge can be more accurately generated.

In this way, when the width W1 of the third electrode 22 in the first position corresponding to the inside of the discharge cell is formed to be broader than the width W2 of the third electrode 22 in the second position corresponding to the second barrier rib 21*b*, the width W1 of the third electrode 22 in the first position corresponding to the inside of the discharge cell becomes gradually narrow in the boundary of the discharge cell and fixed with the width W2 of the third electrode 22 in the second position.

As described in the above, by changing the width of the third electrode, the time from the application of the scan voltage to the generation of the discharge in the address period can be reduced such that the jitter character is improved to improve the discharge efficiency.

In this way, in the embodiment of the present invention, the region where the first electrode or the second electrode and the third electrode 22 are overlapped can be broadened to generate the opposing discharge well. As shown in FIG. 11*a*, in the whole region overlapped with the first electrode and the second electrode, the width W1 of the third electrode can be broader than the width W2 of the outside of the discharge cell overlapped with the barrier rib.

As to another embodiment, as shown in FIG. 11*b*, the width W1 of the third electrode can be formed to be broader in the region where one of the first electrode and the second electrode and the third electrode are overlapped.

As to still another embodiment, as shown in FIG. 11*c*, the width of the third electrode 22 in the central part of the discharge cell becomes gradually broader such that the lozenge can be formed.

Embodiments of the present invention described above are combined with various forms to be implemented.

As described in the above, the plasma display apparatus according to the present invention has the effect that a contrast is improved, and the reactive current is reduced by increasing a luminance and lowering the panel capacitance. Further, it has the effect that the emission of the light by a discharge is smoothly performed such that a luminance can be increased and the interference of the adjacent cells can be minimized, and it has the effect that the panel capacitance generated by a barrier rib is lowered such that the reactive current is reduced. Thereby, it has the effect that the sustain period where an image is displayed can be secured relatively longer since the address time during which the scan pulse is applied is reduced, and it has the effect that the discharge efficiency can be improved by improving the jitter characteristic when the width of the third electrode is variously changed.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display apparatus comprising:

a front substrate where a first electrode is formed in parallel with a second electrode;

a rear substrate where a third electrode is formed to intersect with the first electrode and the second electrode;

a first barrier rib and a second barrier rib that form a discharge cell by intersecting with each other between the front substrate and the rear substrate; and a first black layer formed in a position corresponding to the second barrier rib on the front substrate, wherein the second barrier rib is formed in parallel with the first electrode and the second electrode, wherein each of the first electrode and the second electrode is separately disposed into a direction of a center of the discharge cell from an edge of an upper portion of the second barrier rib, and a longest distance between the first electrode and the second electrode ranges from 0.5 times to 1 times of a distance between edges of upper portions of the adjacent second barrier ribs, and wherein the first black layer is separated from the first electrode and the second electrode.

2. The plasma display apparatus of claim 1, wherein the longest distance between the first electrode and the second electrode ranges from 0.5 times to 0.8 times of the distance between the edges of the upper portions of the adjacent second barrier ribs.

3. The plasma display apparatus of claim 1, wherein a height of the first barrier rib is greater than a height of the second barrier rib.

4. The plasma display apparatus of claim 1, wherein the first electrode and the second electrode include a transparent electrode and a bus electrode respectively, and a second black layer is formed between the transparent electrode and the bus electrode.

5. The plasma display apparatus of claim 4, wherein a width of the first black layer is greater than a width of the second black layer.

6. The plasma display apparatus of claim 1, wherein the first electrode and the second electrode are each comprised of a bus electrode.

7. The plasma display apparatus of claim 1, wherein a width of the third electrode is greater in inside of the discharge cell than in outside of the discharge cell.

8. The plasma display apparatus of claim 1, wherein a width of the third electrode formed inside of the discharge cell is different in the discharge cell radiating a different color.

9. The plasma display apparatus of claim 1, wherein at least one of the first electrode and the second electrode is formed in a position overlapped with a part except the edge of the upper portion of the second barrier rib.

10. A plasma display apparatus comprising:

a first electrode and a second electrode on a first substrate;

a third electrode on a second substrate that faces the first substrate;

a first barrier rib and a second barrier rib that form a discharge cell between the first substrate and the second substrate, the second barrier rib being substantially parallel to the first electrode and the second electrode; and a first black layer on the first substrate at a position corresponding to the second barrier rib, the first black layer being separated from the first electrode and the second electrode, wherein each of the first electrode and the second electrodes is separately disposed toward a center of the discharge cell from an edge of an upper portion of the second barrier rib, wherein a first distance is a distance between an outer edge of the first electrode of the discharge cell and an outer edge of the second electrode of the discharge cell, a second distance is a distance between edges of upper portions of adjacent second barrier ribs about the discharge cell, and wherein the first distance is 0.5 to 1.0 times the second distance.

11. The plasma display apparatus of claim 10, wherein the first distance is 0.5 times to 0.8 times the second distance.

12. The plasma display apparatus of claim 10, wherein the first electrode includes a transparent electrode and a bus electrode, and a second black layer is formed between the transparent electrode and the bus electrode.

13. The plasma display apparatus of claim 12, wherein a width of the first black layer is greater than a width of the second black layer.

14. The plasma display apparatus of claim 10, wherein the second electrode includes a transparent electrode and a bus electrode, and a second black layer is formed between the transparent electrode and the bus electrodes.

15. The plasma display apparatus of claim 14, wherein a width of the first black layer is greater than a width of the second black layer.

16. The plasma display apparatus of claim 10, wherein a width of the third electrode is greater inside the discharge cell than outside the discharge cell.

17. The plasma display apparatus of claim 10, wherein a width of the third electrode formed inside the discharge cell is different in a discharge cell radiating a different color.

18. The plasma display apparatus of claim 10, wherein at least one of the first electrode and the second electrode is formed in a position overlapped with a part except the edge of the upper portion of the second barrier rib.

19. The plasma display apparatus of claim 10, wherein a height of the first barrier rib is greater than a height of the second barrier rib.

* * * * *